US011810479B1

(12) United States Patent
Wiles

(10) Patent No.: US 11,810,479 B1
(45) Date of Patent: Nov. 7, 2023

(54) DEPLOYABLE STOP SIGN FOR USE WITH A TRAFFIC LIGHT DURING POWER LOSS

(71) Applicant: John P. Wiles, Statesville, NC (US)

(72) Inventor: John P. Wiles, Statesville, NC (US)

( * ) Notice: Subject to any disclaimer, the term of this patent is extended or adjusted under 35 U.S.C. 154(b) by 202 days.

(21) Appl. No.: 17/539,263

(22) Filed: Dec. 1, 2021

(51) Int. Cl.

| | |
|---|---|
| ***G09F 11/20*** | (2006.01) |
| ***G09F 11/34*** | (2006.01) |
| ***G08G 1/07*** | (2006.01) |
| ***G08G 1/095*** | (2006.01) |
| ***G08G 1/097*** | (2006.01) |
| ***G09F 11/21*** | (2006.01) |

(52) U.S. Cl.
CPC ..... *G09F 11/20* (2013.01); *G08G 1/07* (2013.01); *G08G 1/095* (2013.01); *G08G 1/097* (2013.01); *G09F 11/21* (2013.01); *G09F 11/34* (2013.01)

(58) Field of Classification Search
CPC ..... G09F 11/20; G09F 11/21; G09F 11/34; G09F 7/22; G09F 15/0087; G09F 11/02; G08G 1/097; G08G 1/07; G08G 1/095
See application file for complete search history.

(56) References Cited

U.S. PATENT DOCUMENTS

| | | | | |
|---|---|---|---|---|
| 4,642,605 | A | 2/1987 | Karp | |
| 5,208,584 | A | 5/1993 | Kaye | |
| 5,252,969 | A | 10/1993 | Kishi | |
| 5,504,481 | A | 4/1996 | Wys | |
| 5,659,305 | A | 8/1997 | Rains | |
| 6,034,609 | A | 3/2000 | Comiskey, Jr. | |
| 6,115,951 | A | 9/2000 | Jing | |
| 6,118,388 | A | 9/2000 | Morrison | |
| 6,268,805 | B1 | 7/2001 | Simon | |
| 6,392,563 | B1 | 5/2002 | Paquette | |
| 6,688,028 | B2 * | 2/2004 | Backe | G09F 15/0087 40/466 |
| 6,956,502 | B1 | 10/2005 | Bartinelli | |
| 7,586,421 | B2 | 9/2009 | Witte | |
| 8,362,923 | B2 | 1/2013 | Witte | |
| 9,554,676 | B1 | 1/2017 | Bisciotti | |
| 10,217,355 | B1 * | 2/2019 | Snyder | G08G 1/095 |
| 10,253,468 | B1 | 4/2019 | Linville | |
| 10,417,908 | B2 * | 9/2019 | Nicholson | G09F 21/04 |
| 10,657,810 | B2 * | 5/2020 | Beaulieu | G08G 1/07 |
| 2004/0008126 | A1 | 1/2004 | Diba | |
| 2005/0012641 | A1 | 1/2005 | Metz | |
| 2007/0103337 | A1 | 5/2007 | Heam | |
| 2008/0258933 | A1 | 10/2008 | Diba | |

(Continued)

FOREIGN PATENT DOCUMENTS

| | | |
|---|---|---|
| CA | 2474572 | 1/2005 |

*Primary Examiner* — John A Tweel, Jr.
(74) *Attorney, Agent, or Firm* — Kyle A. Fletcher, Esq.

(57) ABSTRACT

The deployable stop sign for use with a traffic light during power loss comprises an enclosure, a traffic sign, a weight, a pair of electromagnets, and a sign retractor. The deployable stop sign for use with a traffic light during power loss may be coupled to a span wire or other structure supporting one or more traffic signals. A loss of power may deploy the traffic sign by deenergizing the pair of electromagnets and releasing the weight which may pull the traffic sign out of the enclosure. A restoration of power may energize the sign retractor to pull the traffic sign back into the enclosure and may energize the pair of electromagnets to hold the traffic sign within the enclosure.

18 Claims, 8 Drawing Sheets

(56) References Cited

U.S. PATENT DOCUMENTS

| | | | |
|---|---|---|---|
| 2008/0291053 | A1 | 11/2008 | O'Brien |
| 2016/0196743 | A1 | 7/2016 | Garcia |
| 2019/0236943 | A1 | 8/2019 | West |

* cited by examiner

DEPLOYABLE STOP SIGN FOR USE WITH A TRAFFIC LIGHT DURING POWER LOSS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of traffic control signals, more specifically, a deployable stop sign for use with a traffic light during power loss.

SUMMARY OF INVENTION

The deployable stop sign for use with a traffic light during power loss comprises an enclosure, a traffic sign, a weight, a pair of electromagnets, and a sign retractor. The deployable stop sign for use with a traffic light during power loss may be coupled to a span wire or other structure supporting one or more traffic signals. A loss of power may deploy the traffic sign by deenergizing the pair of electromagnets and releasing the weight which may pull the traffic sign out of the enclosure. A restoration of power may energize the sign retractor to pull the traffic sign back into the enclosure and may energize the pair of electromagnets to hold the traffic sign within the enclosure.

An object of the invention is to deploy a traffic sign from an enclosure during a power loss which disabled traffic lights and to retract the traffic sign into the enclosure when power is restored.

Another object of the invention is to hold the traffic sign in the non-deployed position using a pair of energized electromagnets to retain a weight that is coupled to the bottom of the traffic sign.

A further object of the invention is to deenergize the pair of electromagnets during the power loss such that the weight may pull the traffic sign out of the enclosure.

Yet another object of the invention is to energize a sign retractor to pull the traffic sign into the enclosure when power is restored.

These together with additional objects, features and advantages of the deployable stop sign for use with a traffic light during power loss will be readily apparent to those of ordinary skill in the art upon reading the following detailed description of the presently preferred, but nonetheless illustrative, embodiments when taken in conjunction with the accompanying drawings.

In this respect, before explaining the current embodiments of the deployable stop sign for use with a traffic light during power loss in detail, it is to be understood that the deployable stop sign for use with a traffic light during power loss is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the deployable stop sign for use with a traffic light during power loss.

It is therefore important that the claims be regarded as including such equivalent construction insofar as they do not depart from the spirit and scope of the deployable stop sign for use with a traffic light during power loss. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
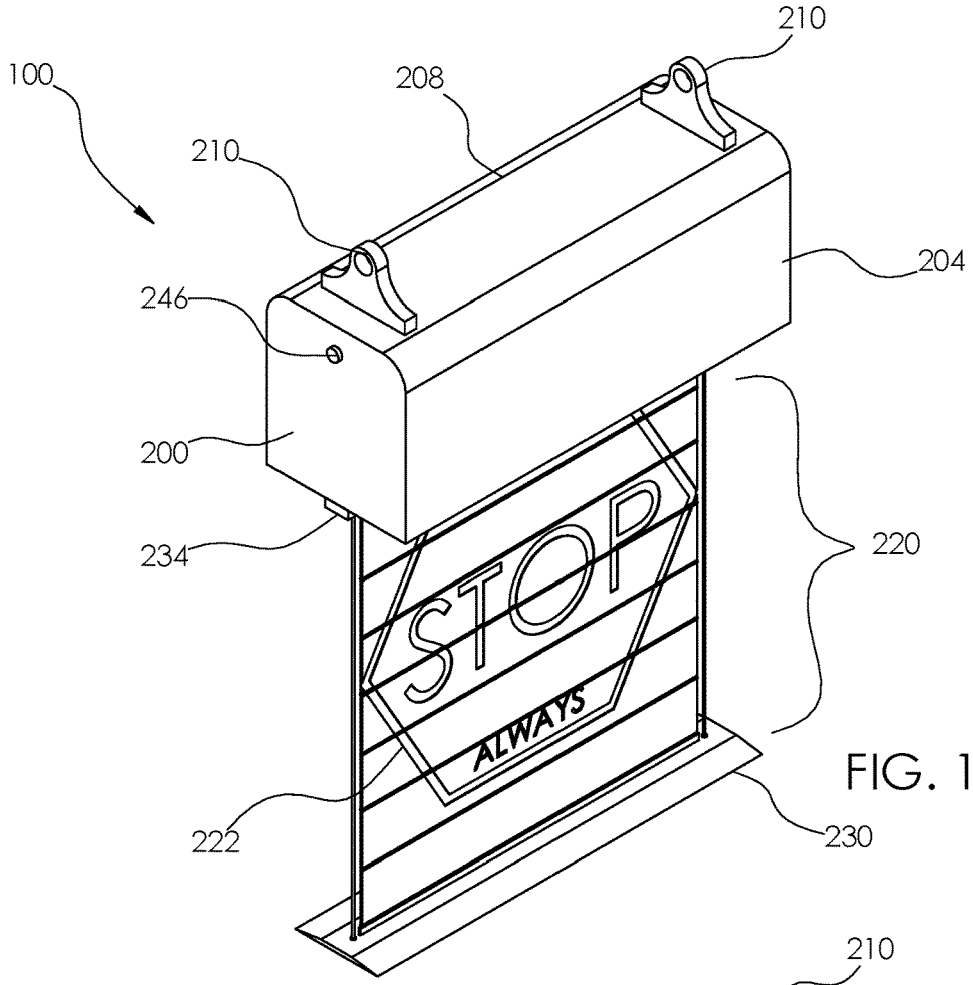
FIG. 1 is an isometric view of an embodiment of the disclosure illustrating the traffic sign in the deployed position.
Figure 2:
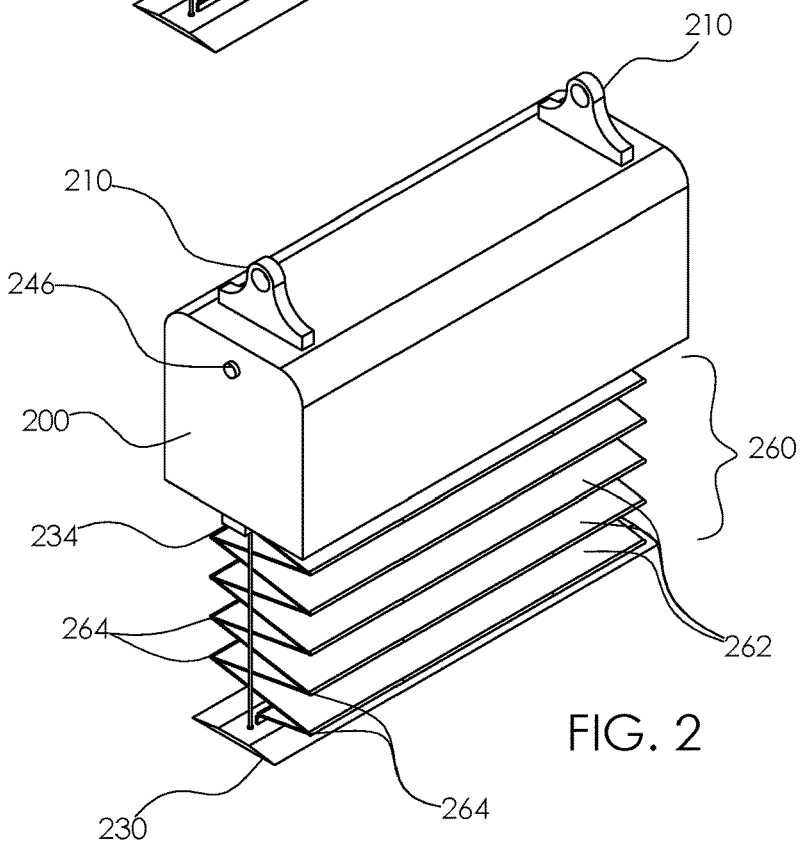
FIG. 2 is an isometric view of an embodiment of the disclosure illustrating the traffic sign being retracted.
Figure 3:
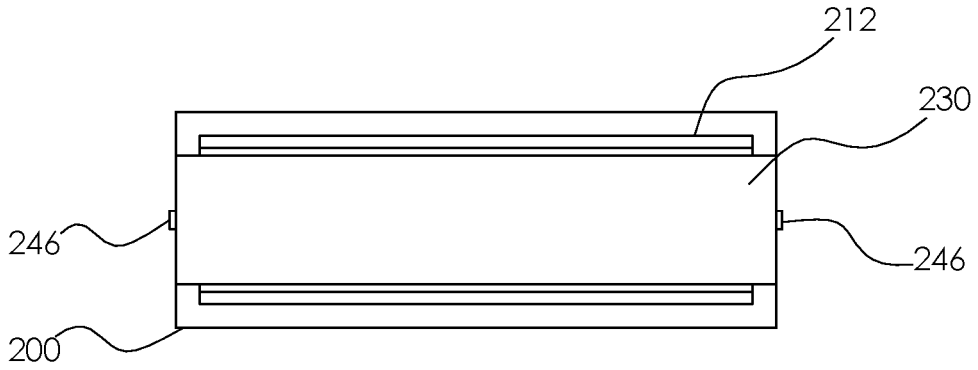
FIG. 3 is a bottom view of an embodiment of the disclosure.
Figure 4:
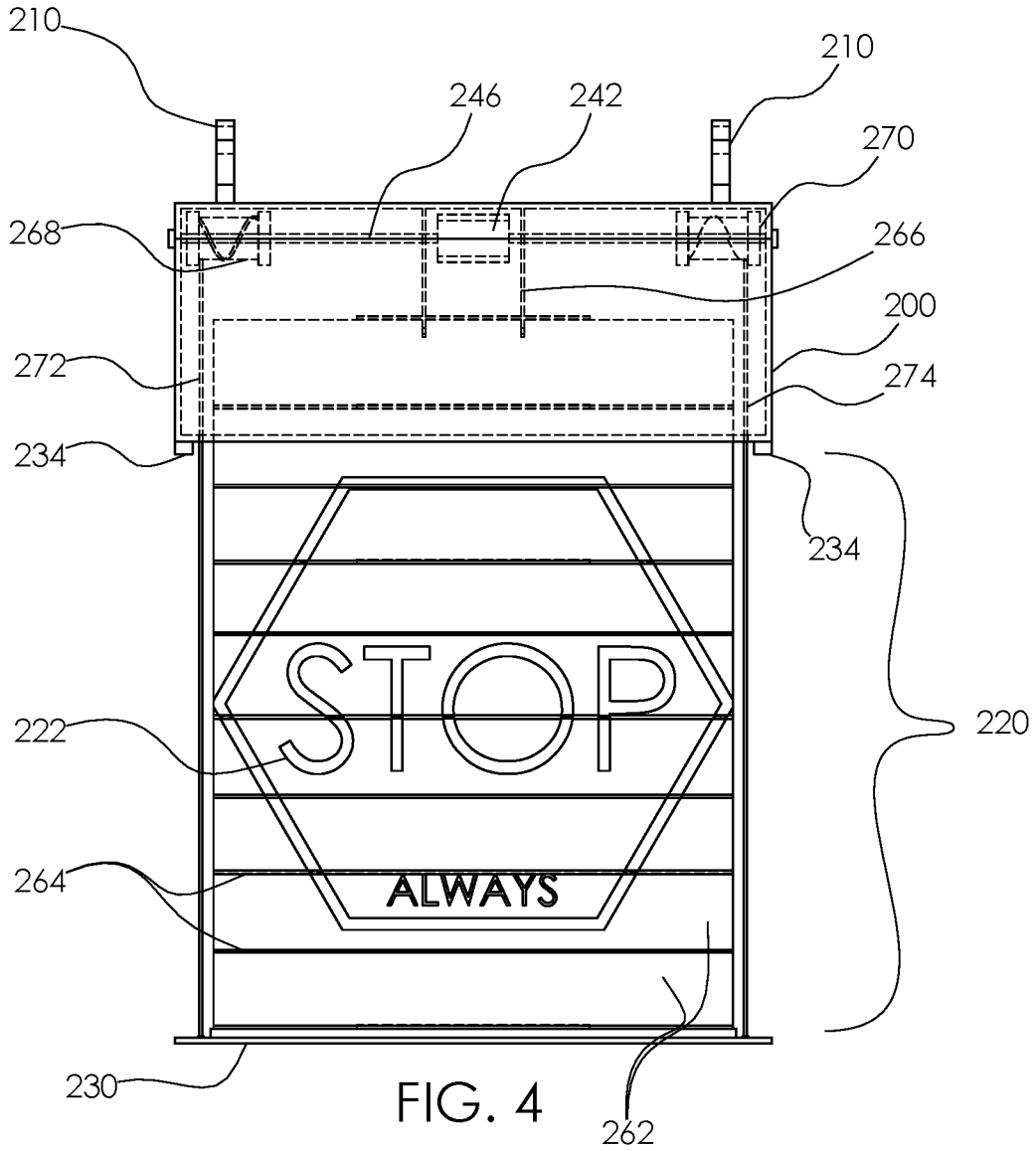
FIG. 4 is a front view of an embodiment of the disclosure illustrating the traffic sign in the deployed position.
Figure 5:
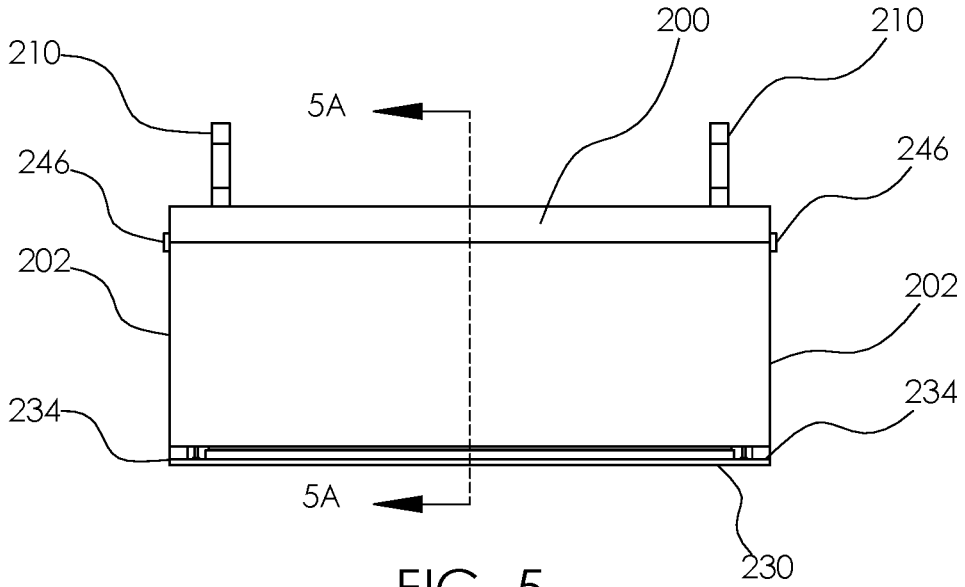
FIG. 5 is a front view of an embodiment of the disclosure illustrating the traffic sign in the retracted position.
Figure 5A:
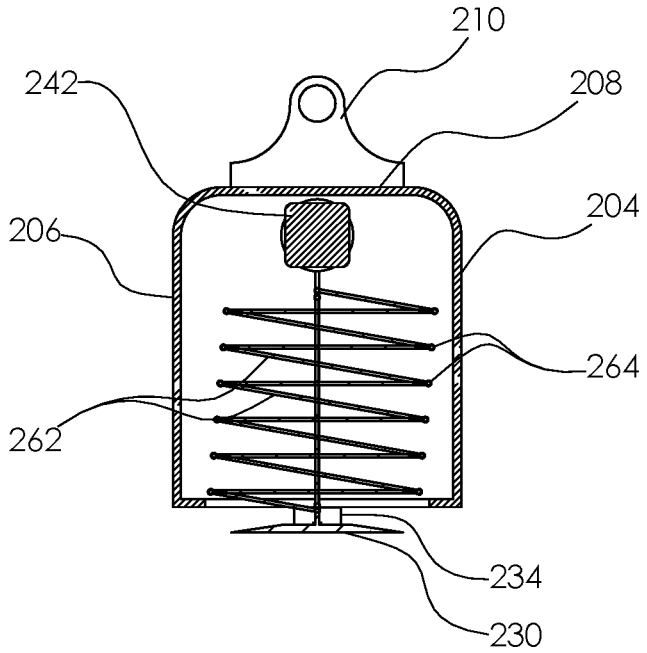
FIG. 5A is a cross-sectional view of an embodiment of the disclosure across 5A-5A as shown in FIG. 5.
Figure 6:
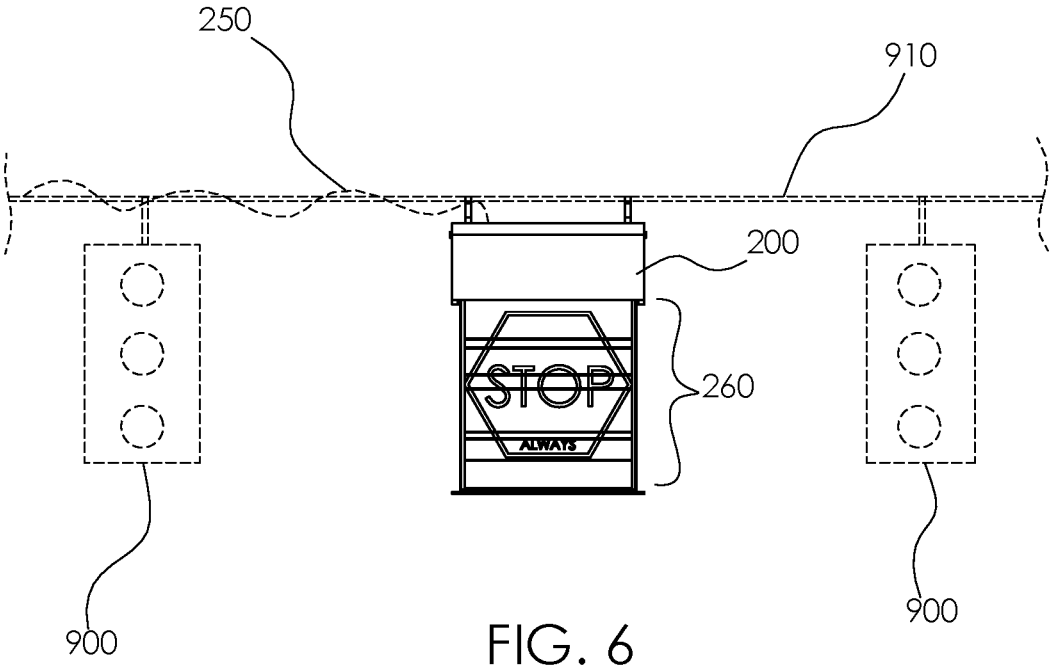
FIG. 6 is an in-use view of an embodiment of the disclosure.
Figure 7:
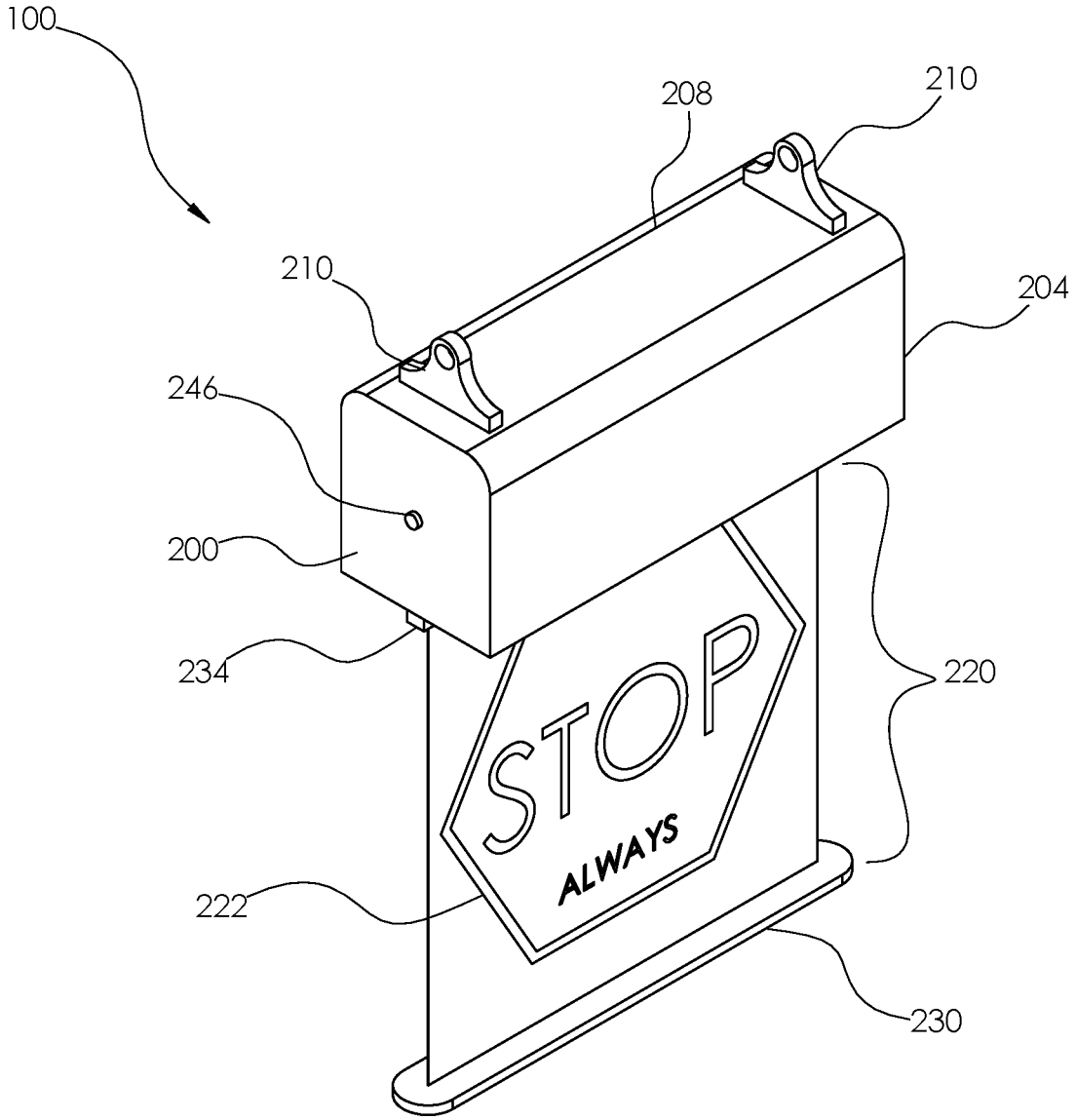
FIG. 7 is an isometric view of a second embodiment of the disclosure illustrating the traffic sign in the deployed position.
Figure 8:
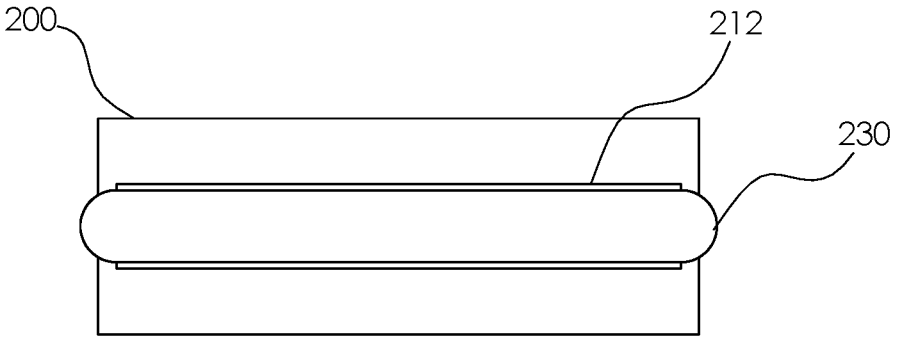
FIG. 8 is a bottom view of a second embodiment of the disclosure.
Figure 9:
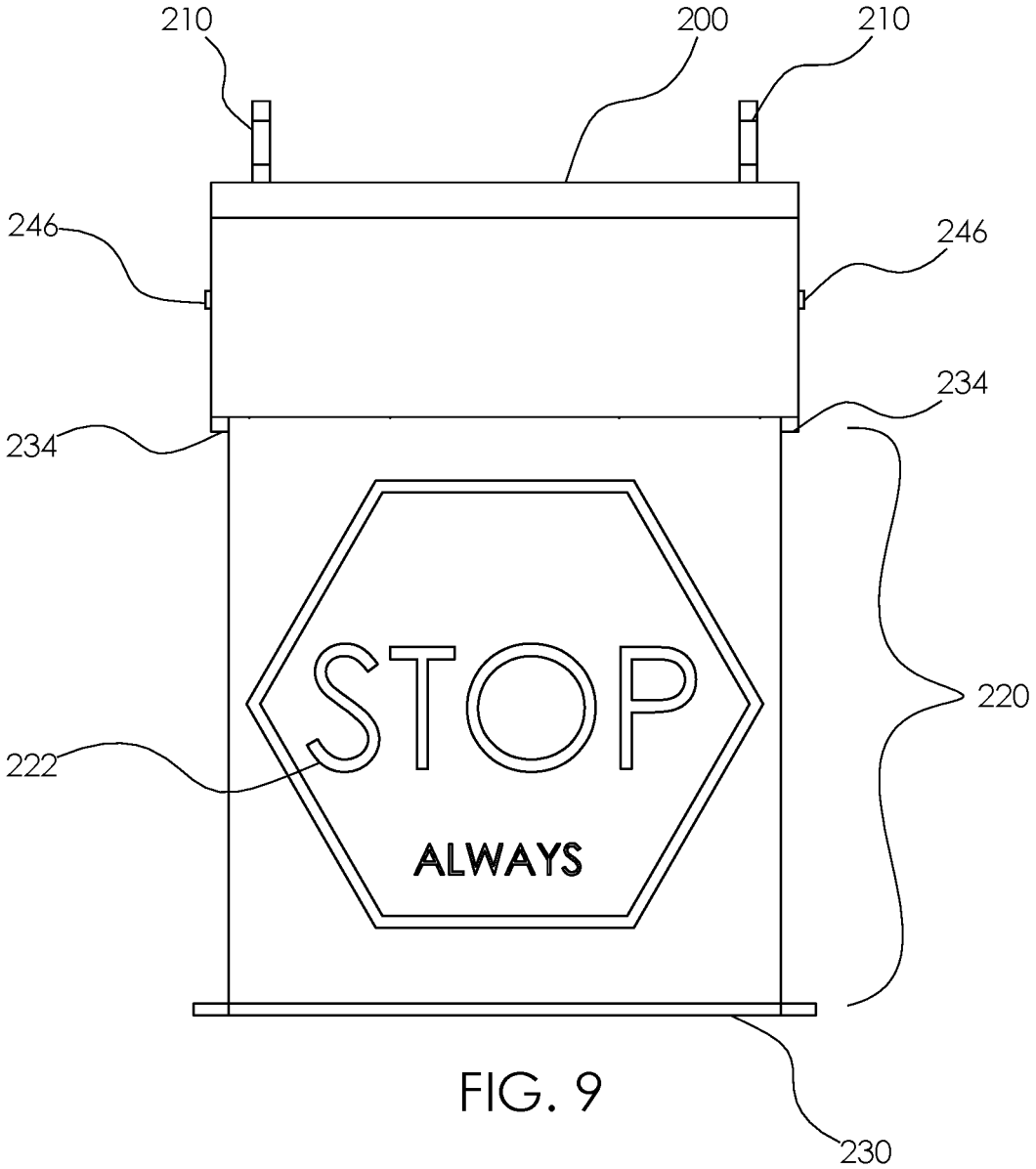
FIG. 9 is a front view of a second embodiment of the disclosure illustrating the traffic sign in the deployed position.
Figure 10:
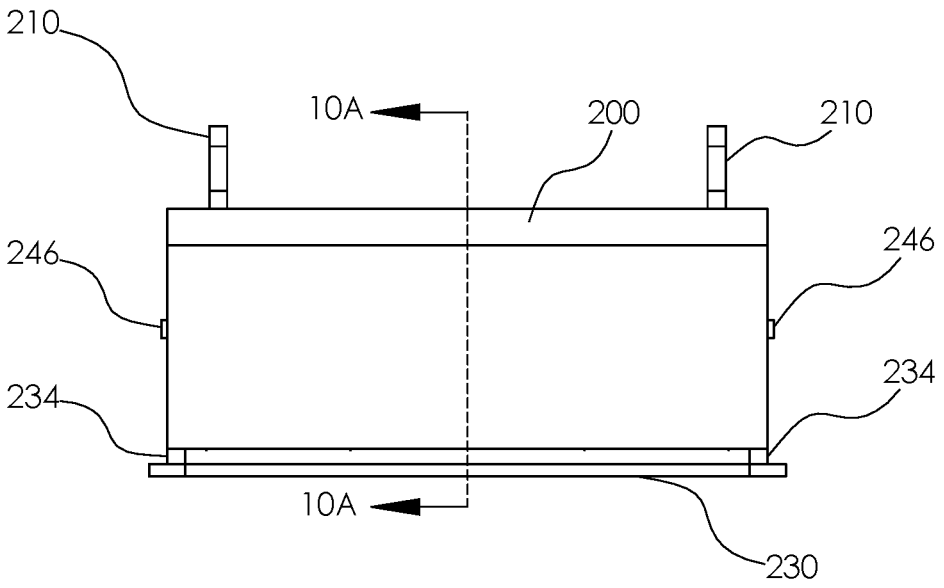
FIG. 10 is a front view of a second embodiment of the disclosure illustrating the traffic sign in the retracted position.
Figure 10A:
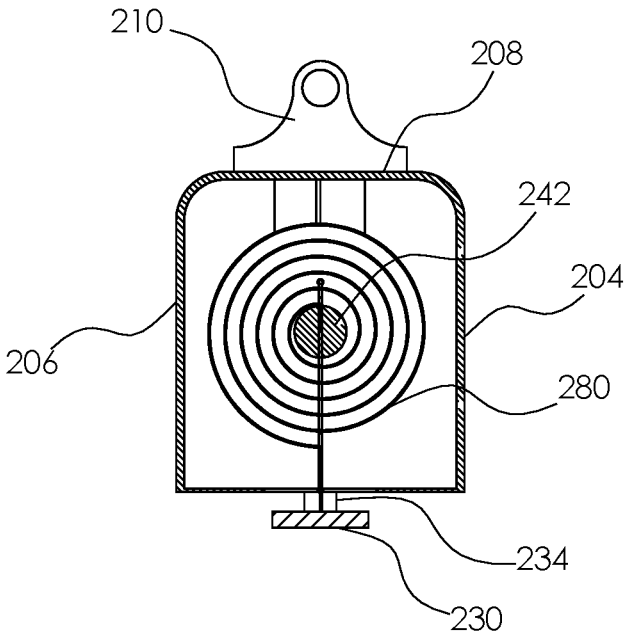
FIG. 10A is a cross-sectional view of a second embodiment of the disclosure across 10A-10A as shown in FIG. 10.
Figure 11:
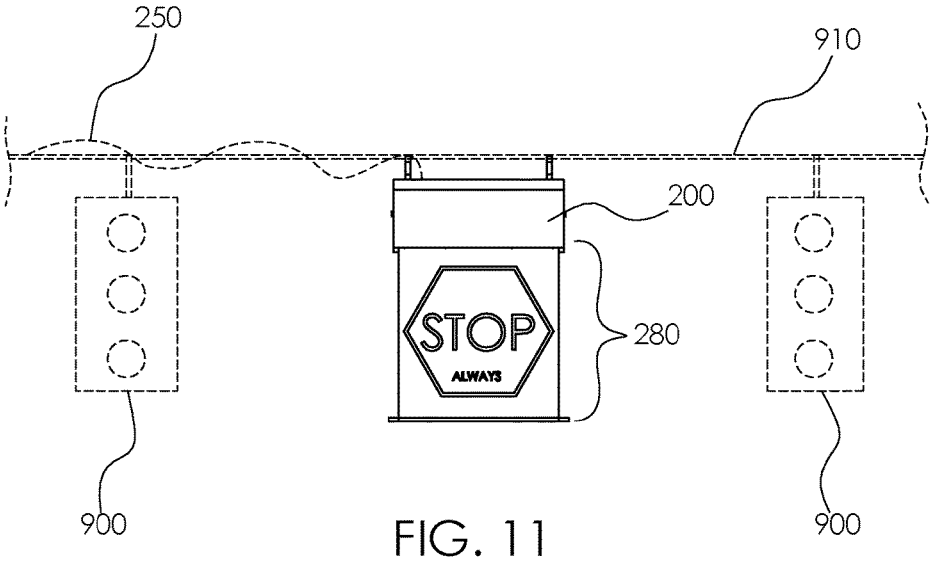
FIG. 11 is an in-use view of a second embodiment of the disclosure.
Figure 12:
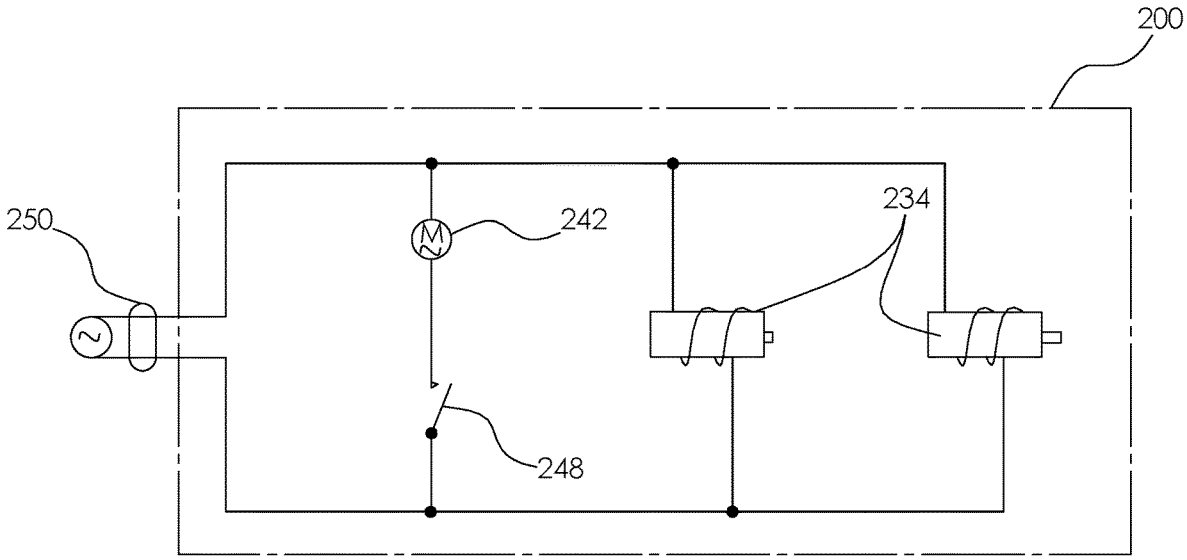
FIG. 12 is a schematic diagram depicting relevant aspects of an example circuit used in an embodiment of the disclosure.

Detailed reference will now be made to a first potential embodiment of the disclosure, which is illustrated in FIGS. 1 through 12.

The deployable stop sign for use with a traffic light during power loss 100 (hereinafter invention) comprises an enclosure 200, a traffic sign 220, a weight 230, a pair of electromagnets 234, and a sign retractor. The invention 100 may be coupled to a span wire 910 or other structure supporting one or more traffic signals 900. A loss of power may deploy the traffic sign 220 by deenergizing the pair of electromagnets 234 and releasing the weight 230 which may pull the traffic sign 220 out of the enclosure 200. A restoration of power may energize the sign retractor to pull the traffic sign 220 back into the enclosure 200 and may energize the pair of electromagnets 234 to hold the traffic sign 220 within the enclosure 200.

The enclosure 200 may comprise two side walls 202, a front wall 204, a rear wall 206, and a top wall 208. The enclosure 200 may house the traffic sign 220, a motor 242, and an axle 246. The enclosure 200 may comprise a bottom aperture 212 through which the traffic sign 220 may be deployed and retracted. The top wall 208 may comprise one or more mounting couplers 210 which may couple the enclosure 200 to the span wire 910 or to the other structure supporting the one or more traffic signals 900.

The traffic sign 220 may display indicia 222 on one or both sides of the traffic sign 220. The indicia 222 may comprise letters, numbers, symbols, or combinations thereof. The indicia 222 may convey a regulatory traffic message. As a non-limiting example, the regulatory traffic message may advise vehicles to come to a full stop before proceeding safely. The top of the traffic sign 220 may be coupled within the enclosure 200 such that the traffic sign 220 may hang from the enclosure 200. The bottom of the traffic sign 220 may be coupled to the weight 230 such that the traffic sign 220 may be pulled taut by the weight 230.

The traffic sign 220 is said to be deployed when the traffic sign 220 is suspended below the enclosure 200 and thereof visible. The traffic sign 220 is said to be retracted when the traffic sign 220 is pulled up into the enclosure 200 and thereof not visible.

The weight 230 may be made from a magnetic material such that the weight 230 may be retained in the retracted position by the pair of electromagnets 234. As a non-limiting example, the weight 230 may be made of one or more ferromagnetic metals.

The pair of electromagnets 234 may be coupled to the bottom of the enclosure 200 adjacent to the bottom aperture 212 and on opposite sides of the bottom aperture 212 such that the pair of electromagnets 234 may contact the weight 230 when the traffic sign 220 is retracted. The pair of electromagnets 234 may be energized when the invention 100 is powered and may retain the weight 230 in position at the bottom of the enclosure 200. The pair of electromagnets 234 may be deenergized during the loss of power and may release the weight 230.

The pair of electromagnets 234 may receive power via a power cable 250 which may be connected to the same source of power that power the one or more traffic signals 900 such that the invention 100 may detect when the one or more traffic signals 900 are powered. As non-limiting examples, the invention 100 may receive power from a traffic light controller that controls the state of the one or more traffic signals 900. In some embodiments, the invention 100 may lose power simultaneously with the traffic light controller losing power during a power interruption. In some embodiments, the traffic light controller may comprise a battery backup such that the one or more traffic signals 900 may continue operating through short power interruptions and the invention 100 may remain powered until the battery backup is depleted.

The sign retractor may comprise the motor 242 and the axle 246. The sign retractor may pull the traffic sign 220 into the enclosure 200 when power is applied to the invention 100. The motor 242 may be energized when the invention 100 is powered and may rotate the axle 246 in order to retract the traffic sign 220. The sign retractor may comprise a limit switch 248 located at the bottom of the enclosure 200. The motor 242 may be deenergized during the loss of power or by the limit switch 248. The limit switch 248 may be activated by the presence of the weight 230 such that the motor 242 may be deenergized when the weight 230 reaches the enclosure 200 during retraction of the traffic sign 220.

The motor 242 may convert electrical energy into mechanical energy. The motor 242 may cause rotary motion of the axle 246 when the electrical energy is applied to the motor 242. The rotary motion of the axle 246 may retract the traffic sign 220. When the motor 242 is deenergized, the motor 242 may be free to turn such that the traffic sign 220 may be pulled down by the weight 230.

The axle 246 may be pivotably coupled to the two side walls 202 in an orientation that is parallel to the longitudinal axis of the weight 230.

In some embodiments, the traffic sign 220 may be a pleated sign 260 comprising a plurality of plates 262 that are coupled via a plurality of sign hinges 264 such that the traffic sign 220 may accordion fold when retracted. The plurality of plates 262 may be made of a non-magnetic material. As a non-limiting example, the plurality of plates 262 may be made of aluminum. The top of the pleated sign 260 may couple to a sign mount 266 located within interior of the enclosure 200 at the top of the enclosure 200.

The pleated sign 260 may be retracted by a left cable 272 and a right cable 274. The top of the left cable 272 may be coupled to a left pulley 268 and the top of the right cable 274 may be coupled to a right pulley 270. The bottom of the left cable 272 may be coupled to the left side of the weight 230 and the bottom of the right cable 274 may be coupled to the right side of the weight 230. The left pulley 268 and the right pulley 270 may be coupled to opposing ends of the axles 246 such that rotation of the axle 246 by the motor 242 may result in retraction of the pleated sign 260 by the left cable 272 and the right cable 274.

In some embodiments, the traffic sign 220 may be a roll-up sign 280 that wraps around the axle 246 when retracted. The roll-up sign 280 may be made of a flexible material. As a non-limiting example, the roll-up sign 280 may be made of vinyl. The top of the roll-up sign 280 may couple to the axle 246.

In use, the enclosure 200 may be coupled to the span wire 910 or the other structure supporting the one or more traffic signals 900 and the power cable 250 may be coupled to the traffic light controller. Initially, the traffic sign 220 may be retracted into the enclosure 200 and retained by the pair of electromagnets 234 attraction to the weight 230. During a loss of power, the pair of electromagnets 234 may be deenergized and may release the weight 230. The weight 230 may pull the traffic sign 220 out of the enclosure 200, thus deploying the traffic sign 220. A restoration of power may energize the sign retractor to retract the traffic sign 220 back into the enclosure 200 and may energize the pair of electromagnets 234 to hold the traffic sign 220 within the enclosure 200.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "accordion fold" may be a pleated structure that resembles the bellows of an accordion. When used as a verb, "accordion fold" may refer to the act of collapsing by pivoting adjacent components in opposite directions to form a pleat.

As used in this disclosure, an "aperture" may be an opening in a surface. Aperture may be synonymous with hole, slit, crack, gap, slot, or opening.

As used in this disclosure, an "axle" may be a cylindrical shaft that is inserted through the center of an object such that the center axis of the object and the center axis of the axle are aligned and the object can rotate using the axle as an axis of rotation.

As used herein, the words "couple", "couples", "coupled" or "coupling", may refer to connecting, either directly or indirectly, and does not necessarily imply a mechanical connection.

As used herein, "energize" and/or "energization" may refer to the application of an electrical potential to a system or subsystem.

As used in this disclosure, "flexible" may refer to an object or material which will deform when a force is applied to it, which will not return to its original shape when the deforming force is removed, and which may not retain the deformed shape caused by the deforming force.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, the term "indicia" may refer to a set of markings that identify a sentiment.

As used in this disclosure, the word "interior" may be used as a relational term that implies that an object is located or contained within the boundary of a structure or a space.

As used herein, "limit switch" may refer to a switch that is operated by the motion of a machine or the presence of an object. As a non-limiting example, a limit switch may limit the travel of an object by breaking a circuit when the object reaches a predefined position.

As used in this disclosure, a "magnetic material" may be a substance that attracts or is attracted to a magnet but that itself has no net magnetic moment (beyond any residual moment created by prior use). Common classes of magnetic materials include ferromagnetic, diamagnetic, paramagnetic, ferrimagnetic and antiferromagnetic.

As used in this disclosure, a "motor" may refer to a device that transforms energy from an external power source into mechanical energy.

As used in this disclosure, "orientation" may refer to the positioning and/or angular alignment of a first object relative to a second object or relative to a reference position or reference direction.

As used in this disclosure, a "sign" may be a placard that displays an image, potentially including a text based image, which contains some form of a sentiment.

As used in this disclosure, a "switch" may be an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

With respect to the above description, it is to be realized that the optimum dimensional relationship for the various components of the invention described above and in FIGS. 1 through 12, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A deployable stop sign for use with a traffic light during power loss comprising:

an enclosure, a traffic sign, a weight, a pair of electromagnets, and a sign retractor;

wherein the deployable stop sign for use with a traffic light during power loss is coupled to a span wire or other structure supporting one or more traffic signals;

wherein a loss of power deploys the traffic sign by deenergizing the pair of electromagnets and releasing the weight which pulls the traffic sign out of the enclosure;

wherein a restoration of power energizes the sign retractor to pull the traffic sign back into the enclosure and energizes the pair of electromagnets to hold the traffic sign within the enclosure;

wherein the enclosure comprises two side walls, a front wall, a rear wall, and a top wall;

wherein the enclosure houses the traffic sign, a motor, and an axle;

wherein the enclosure comprises a bottom aperture through which the traffic sign is deployed and retracted;

wherein the top wall comprises one or more mounting couplers which couple the enclosure to the span wire or to the other structure supporting the one or more traffic signals.

2. The deployable stop sign for use with a traffic light during power loss according to claim 1 wherein the traffic sign displays indicia on one or both sides of the traffic sign;

wherein the indicia comprises letters, numbers, symbols, or combinations thereof;

wherein the indicia conveys a regulatory traffic message.

3. The deployable stop sign for use with a traffic light during power loss according to claim 2 wherein the top of the traffic sign is coupled within the enclosure such that the traffic sign hangs from the enclosure;

wherein the bottom of the traffic sign is coupled to the weight such that the traffic sign is pulled taut by the weight.

4. The deployable stop sign for use with a traffic light during power loss according to claim 3 wherein the weight is made from a magnetic material such that the weight is retained in the retracted position by the pair of electromagnets.

5. The deployable stop sign for use with a traffic light during power loss according to claim 4 wherein the pair of electromagnets are coupled to the bottom of the enclosure adjacent to the bottom aperture and on opposite sides of the bottom aperture such that the pair of electromagnets contact the weight when the traffic sign is retracted;

wherein the pair of electromagnets are energized when the deployable stop sign for use with a traffic light during power loss is powered and retain the weight in position at the bottom of the enclosure;

wherein the pair of electromagnets are deenergized during the loss of power and release the weight.

6. The deployable stop sign for use with a traffic light during power loss according to claim 5 wherein the pair of electromagnets receive power via a power cable which is connected to the same source of power that power the one or more traffic signals such that the deployable stop sign for use with a traffic light during power loss detects when the one or more traffic signals are powered.

7. The deployable stop sign for use with a traffic light during power loss according to claim 6 wherein the sign retractor comprises the motor and the axle;

wherein the sign retractor pulls the traffic sign into the enclosure when power is applied to the deployable stop sign for use with a traffic light during power loss.

8. The deployable stop sign for use with a traffic light during power loss according to claim 7 wherein the motor is energized when the deployable stop sign for use with a traffic light during power loss is powered and rotates the axle in order to retract the traffic sign.

9. The deployable stop sign for use with a traffic light during power loss according to claim 8 wherein the sign retractor comprises a limit switch located at the bottom of the enclosure;

wherein the motor is deenergized during the loss of power or by the limit switch.

10. The deployable stop sign for use with a traffic light during power loss according to claim 9 wherein the limit switch is activated by the presence of the weight such that the motor is deenergized when the weight reaches the enclosure during retraction of the traffic sign.

11. The deployable stop sign for use with a traffic light during power loss according to claim 10 wherein the motor converts electrical energy into mechanical energy;

wherein the motor causes rotary motion of the axle when the electrical energy is applied to the motor;

wherein the rotary motion of the axle retracts the traffic sign.

12. The deployable stop sign for use with a traffic light during power loss according to claim 11 wherein when the motor is deenergized, the motor is free to turn such that the traffic sign is pulled down by the weight.

13. The deployable stop sign for use with a traffic light during power loss according to claim 12 wherein the axle is pivotably coupled to the two side walls in an orientation that is parallel to the longitudinal axis of the weight.

14. The deployable stop sign for use with a traffic light during power loss according to claim 12 wherein the traffic sign is a pleated sign comprising a plurality of plates that are coupled via a plurality of sign hinges such that the traffic sign accordion folds when retracted;

wherein the plurality of plates are made of a non-magnetic material.

15. The deployable stop sign for use with a traffic light during power loss according to claim 14 wherein the top of the pleated sign couples to a sign mount located within interior of the enclosure at the top of the enclosure.

16. The deployable stop sign for use with a traffic light during power loss according to claim 15 wherein the pleated sign is retracted by a left cable and a right cable;

wherein the top of the left cable is coupled to a left pulley and the top of the right cable is coupled to a right pulley;

wherein the bottom of the left cable is coupled to the left side of the weight and the bottom of the right cable is coupled to the right side of the weight;

wherein the left pulley and the right pulley are coupled to opposing ends of the axles such that rotation of the axle by the motor results in retraction of the pleated sign by the left cable and the right cable.

17. The deployable stop sign for use with a traffic light during power loss according to claim 12 wherein the traffic sign is a roll-up sign that wraps around the axle when retracted;

wherein the roll-up sign is made of a flexible material.

18. The deployable stop sign for use with a traffic light during power loss according to claim 17 wherein the top of the roll-up sign couples to the axle.

* * * * *